United States Patent [19]

Conlon

[11] 4,398,643

[45] Aug. 16, 1983

[54] PLIABLE WEIGHT FOR LABORATORY WARE

[76] Inventor: Daniel R. Conlon, 600 Meetinghouse Rd., Jenkintown, Pa. 19046

[21] Appl. No.: 283,472

[22] Filed: Jul. 15, 1981

[51] Int. Cl.[3] ..... B01L 9/00

[52] U.S. Cl. ..... 215/100 R; 248/DIG. 10; 422/102

[58] Field of Search ..... 215/100 R; 248/DIG. 10, 248/154; 422/102

[56] References Cited

U.S. PATENT DOCUMENTS

| | | | |
|---|---|---|---|
| 3,089,606 | 5/1963 | Rothstein | 215/100 R |
| 3,461,728 | 8/1969 | Paoli | 215/100 R |
| 3,512,301 | 5/1970 | Kramer | 215/100 R X |
| 3,746,293 | 7/1973 | Silvia | 248/DIG. 10 X |
| 3,969,080 | 7/1976 | Conlon | 248/DIG. 10 X |
| 4,055,273 | 10/1977 | Jones | 215/100 R X |

FOREIGN PATENT DOCUMENTS

| | | | |
|---|---|---|---|
| 682045 | 5/1930 | France | 215/100 R |

*Primary Examiner*—William Price
*Assistant Examiner*—Sue A. Weaver
*Attorney, Agent, or Firm*—Paul Lipsitz

[57] ABSTRACT

A weight for stabilizing laboratory ware and the like comprising a lead disc having a plurality of pliable extensions which are essentially symmetrically spaced, said weight being coated with a flexible cushioning material such as polyvinylchloride.

2 Claims, 10 Drawing Figures

PLIABLE WEIGHT FOR LABORATORY WARE

This invention relates to a weight for stabilizing easy to tip equipment, particularly equipment found in chemical laboratories such as flasks, graduated cylinders and the like which have an inherent instability in their upright position. Such chemical equipment, particularly those of smaller sizes (i.e. 100 ml or less) are easily knocked over accidentally causing the contents to spill and/or the container to break, if it is made of glass. It is an object of this invention to provide means for stabilizing such laboratory ware so that it will resist such accidental knockdown.

In my U.S. Pat. No. 3,969,080 I disclose and claim a stabilized container wherein a heavy metal split torus surrounds the container at its base to impart stability. The present invention provides for an improved device, although it may be used in a similar fashion by slipping it over the neck and body of the container to be stabilized, it also may be fitted around the base of the container in several ways.

In accord with this invention I provide in combination, a container and a weight for stabilizing the container which comprises a lead disc having a plurality of flexible extensions or fingers which are essentially symmetrical to the weight, and the weight is optionally, but preferably, coated with a cushioning material. The invention also provides as a novel article of manufacture the coated disc alone.

Returning now to FIG. 1 and 3, it is seen that the disc portion of the device shown generally as 11 has a central hole 13 and a plurality of extensions or fingers 15. The device is made of lead as shown by the uncovered section 17 and the entire device is coated with a cushioning material 19 (see also FIGS. 1 and 5).

Figure 1:
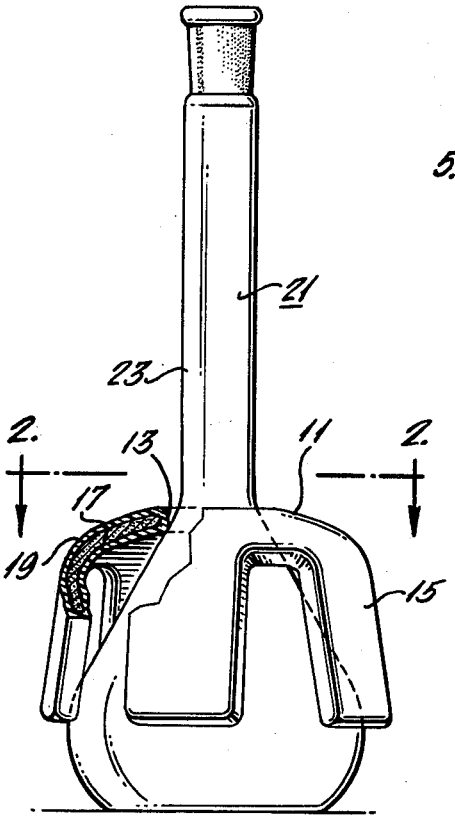
FIG. 1 is a side elevational view of a small flask fitted with the weight in a slip-on slip-off mode.
Figure 2:
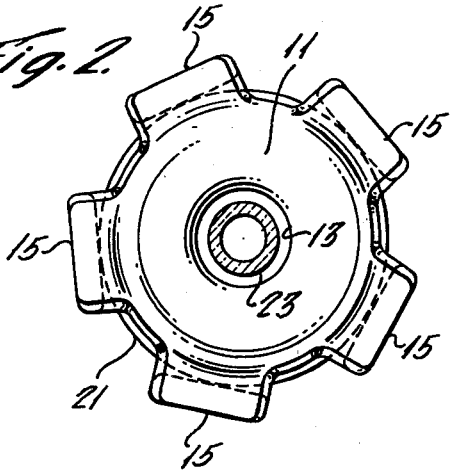
FIG. 2 is a sectional plan view taken on line 2,2 of FIG. 1 showing additional details of the invention.
Figure 6:
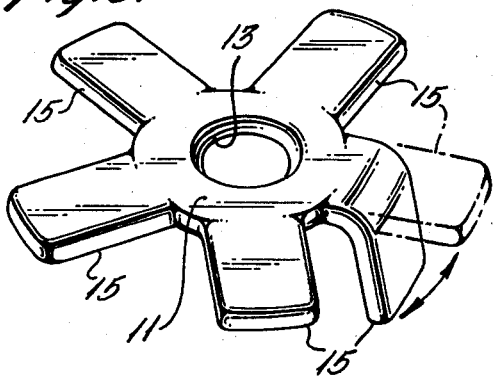
FIG. 6 is a perspective view of the invention where one flexible extension has been bent into a position shown by the full lines from a plane common to the disc portion and the other extensions.

FIG. 1 illustrates one embodiment of use of the device. In FIG. 1 a small volumetric flask is stabilized against accidental tipping by slipping the device over the neck of the flask through the hole 13 in the center of the disc. Then the extensions or fingers 15 are bent downwardly around the bulb portion of the flask. The presence of the stabilizing device on the flask in this manner lowers the center of gravity of the flask and stabilizes it against accidental knockdown. FIG. 2 shows a sectional plan view taken on line 2,2 of FIG. 1 wherein the neck of the flask 23 is surrounded by the stabilizing device 11 through hole 13.

Figure 5:
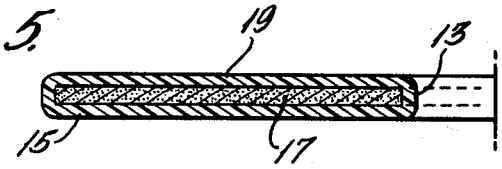
FIG. 5 is a sectional elevation taken on line 5,5 of FIG. 3 showing additional details of the invention.

FIG. 5 shows in detail the coating of cushioning material 19 over the lead core 17 of the device.

Figure 8:
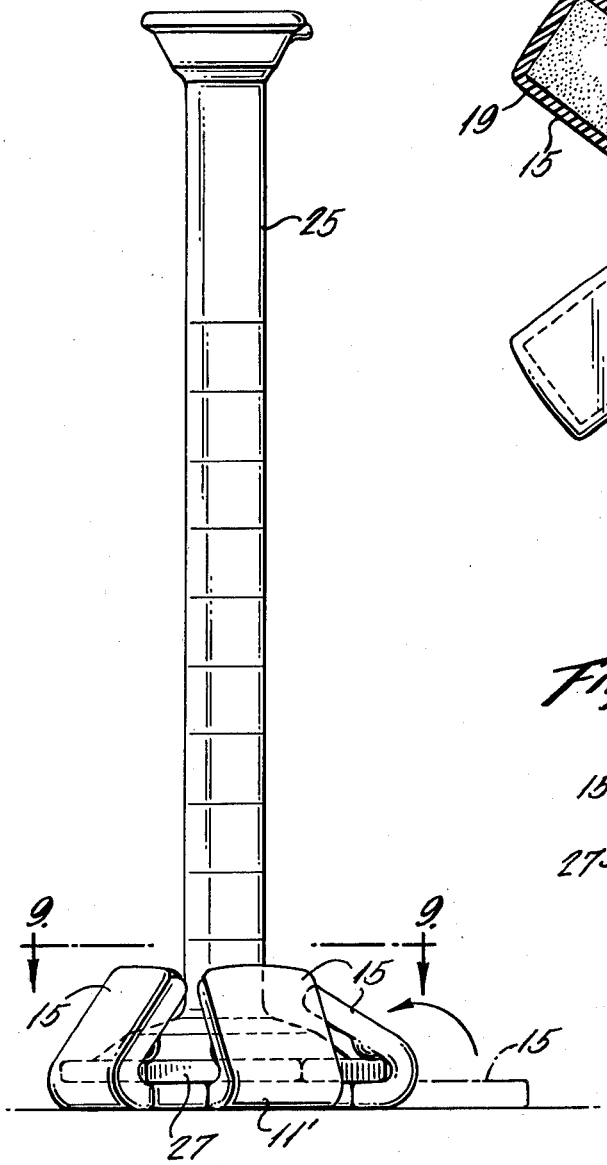
FIG. 8 is a side elevation view of the use of the device of FIG. 7 on the bottom of a graduated cylinder.
Figure 7:
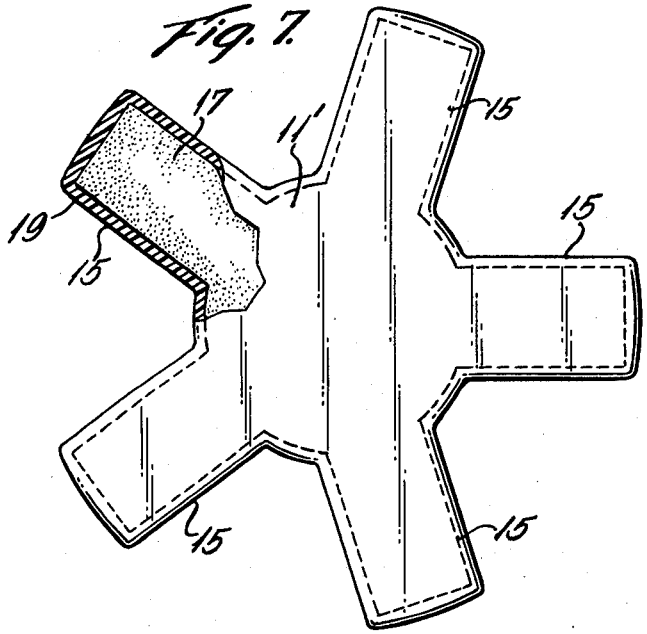
FIG. 7 shows a plan view of an alternative construction of the disc without a central hole.
Figure 9:
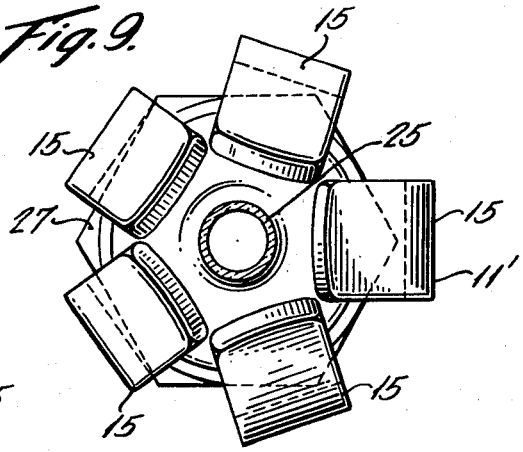
FIG. 9 is a sectional plan view on line 9,9 of FIG. 8.

FIG. 7 shows an alternative embodiment of the invention wherein a stabilizing device without a central hole is shown. Such a device is used as shown in FIG. 8 with a graduate 25 by placing the base 27 of the graduate on the device 11' and bending the extensions 15 upwardly around the base. The device containing a central hole may also be used in this manner, of course.

Figure 3:
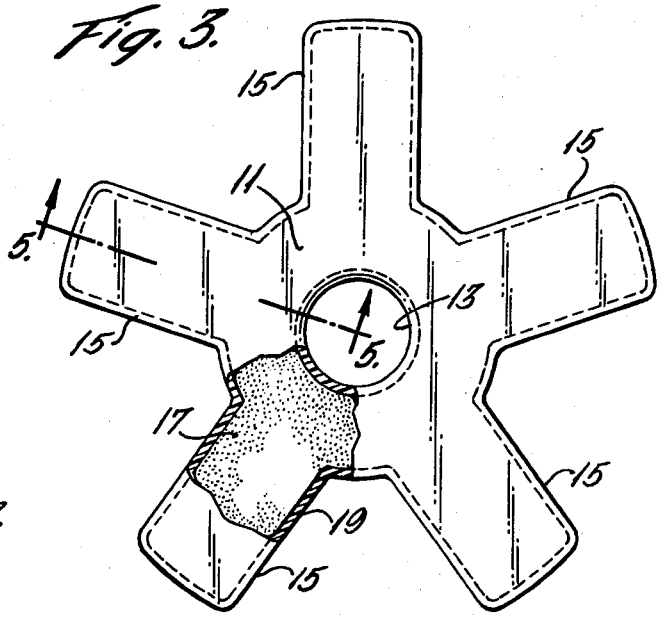
FIG. 3 is a plan view of my weight prior to fitting over the container to be stabilized.
Figure 4:
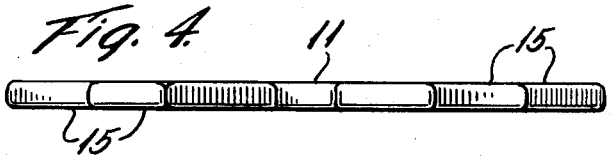
FIG. 4 is a side elevation of the device shown in FIG. 3.
Figure 10:
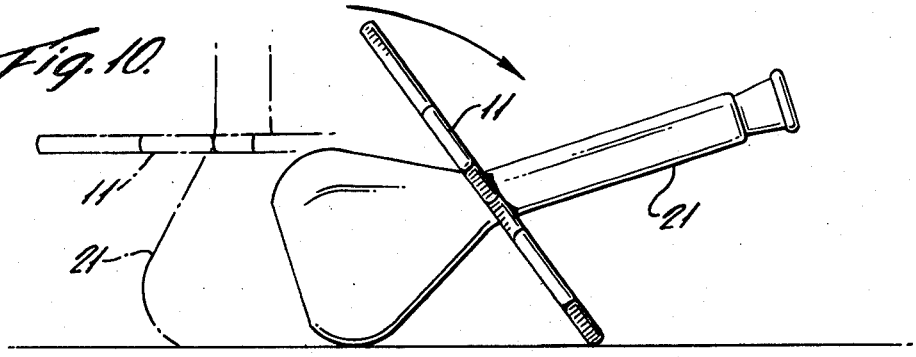
FIG. 10 is a diagrammatic illustration of an alternative use of the device shown in FIG. 3.

FIG. 10 shows the device of FIG. 3 with unbent extensions having been placed over the neck of a small volumetric flask to a point of juncture of the neck with the bulbous portion of the flask, wherein the flask has been overturned from an upright position shown by the dashed lines. As can be seen, the device keeps the overturned flask at an upright angle, so that fluid in the flask is not spilled.

It will be understood that the device may be used in any size consistent with the particular laboratory ware to be stabilized. However, the device is particularly useful with small equipment; e.g. 10 to 500 ml graduated cylinders, volumetric flasks of from 25 to 500 ml and the like. However, the device may also be used with straight-sided containers such as a vial, a small jar and the like.

The device is easily manufactured by stamping out pieces of lead in the shape of the disc with equally spaced extensions as described above and then coated with the cushioning material. The cushioning material may be selected from a wide variety of materials such as cork, cord and polymers such as polyvinyl acetate, polytetrafluoroethylene, polyurethanes and other vinyl polymers and copolymers. Preferably a polyvinyl coating such as polyvinylchloride will be used as this is a relatively inexpensive material, and yet has adequate chemical resistance for general use in a chemical or other research laboratory. The coating may be applied by spraying, dipping, and any of the other known coating techniques.

The invention claimed is:

1. A lead disc with a central hole adapted for stabilizing a container such as a volumetric flask or a graduated cylinder, said disc having a plurality of integral symmetrically spaced flexible extensions, said extensions being capable of being bent downwardly and upwardly from the plane of said disc, and said disc being coated with a cushioning material.

2. The lead disc of claim 1 wherein the cushioning material is polyvinylchloride.

* * * * *